United States Patent [19]

Onuki et al.

[11] 4,236,925

[45] Dec. 2, 1980

[54] METHOD OF PRODUCING SINTERED MATERIAL HAVING HIGH DAMPING CAPACITY AND WEARING RESISTANCE AND RESULTANT PRODUCTS

[75] Inventors: Jin Onuki, Hitachi; Masateru Suwa, Tokai; Ko Soeno, Hitachi; Akio Okayama, Hitachi; Masatoshi Tsuchiya, Hitachi; Hisakiti Onodera, Hitachi, all of Japan

[73] Assignee: Hitachi, Ltd., Japan

[21] Appl. No.: 932,641

[22] Filed: Aug. 10, 1978

[30] Foreign Application Priority Data

Aug. 10, 1977 [JP] Japan ..... 52-95115

[51] Int. Cl.[3] ..... B22F 3/00; B22F 5/00

[52] U.S. Cl. ..... 75/229; 75/200; 75/208 CS; 75/208 R; 75/214; 478/279

[58] Field of Search ..... 75/201, 200, 214, 208 R, 75/208 CS, 229; 428/567

[56] References Cited

U.S. PATENT DOCUMENTS

| | | | |
|---|---|---|---|
| 3,666,455 | 5/1972 | Olstowski | 75/214 |
| 3,681,063 | 8/1972 | Douglass | 75/200 |
| 3,708,282 | 1/1973 | Burr et al. | 75/200 |
| 3,987,730 | 10/1976 | Meadus et al. | 75/200 |
| 4,002,472 | 1/1977 | LeBrasse et al. | 75/200 |
| 4,006,016 | 2/1977 | Zambrow et al. | 75/200 |

*Primary Examiner*—Brooks H. Hunt

*Attorney, Agent, or Firm*—Craig & Antonelli

[57] ABSTRACT

A method of producing a sintered material having a high wearing resistance and damping capacity by mixing 5–30 wt. % of a powdery metal selected from the group consisting of lead, magnesium and graphite with the remainder of a powdery metal selected from the group consisting of iron, copper, aluminum, cast iron and alloys thereof, compression-molding the mixture, subjecting the same to plastic treatment and sintering the same by heating to a temperature above a recrystallization point of the matrix metal, and the sintered material thus produced.

7 Claims, 3 Drawing Figures

DAMPING CAPACITY ( Q⁻¹ X 10³)
20
10
0
C
B
A
D
H
I
G
F
E
0
5
10
15
20
25
30
(%)
LEAD

COEFFICIENT OF FRICTION ( μ )
0.4
0.3
0.2
0.1
0
0
10
20
30 (%)
LEAD

METHOD OF PRODUCING SINTERED MATERIAL HAVING HIGH DAMPING CAPACITY AND WEARING RESISTANCE AND RESULTANT PRODUCTS

BACKGROUND OF THE INVENTION

The present invention relates to a sintered material suitable for the production of structural parts which necessitate wearing resistance and damping capacity.

It has been known that self-lubricating property is imparted to a bearing in case a liquid or semifluid lubricant cannot be used, by producing a sintered material by mixing powdery iron, copper, aluminum, cast iron or an alloy thereof with powdery lead or graphite, compression-molding the mixture and sintering the molding under a reducing atmosphere. If the sintered material produced by above process slides along a shaft, lead or graphite contained in the material is molten by a friction heat to flow on the sliding surface, thereby working as a lubricant.

For example, in Japanese Laying-open of Patent Applications No. 48-13207 (1963) and No. 50-147411 (1975), there are disclosed sintered materials and methods of producing the same which comprise mixing powdery iron or powdery copper with powdery lead or powdery graphite, subjecting the mixture to compression molding and sintering the molding product in a reducing atmosphere. However, the sintered materials produced by those methods have only an insufficient damping capacity due to a form of lead or graphite distributed in the matrix metal such as iron or copper, though they have a high wearing resistance.

Namely, since the conventional methods of producing a sintered material comprise steps of mixing metal powders together, compression-molding the mixture under a pressure of several kilograms per $cm^2$ and sintering the compression-molded mixture at a high temperature, lead or graphite is aggregated in nearly spherical form on the crystal surface of the matrix metal in the sintering operation. Consequently, the resulting sintered material has only an insufficient damping capacity. For improving the damping capacity, it is desirable that lead or graphite is distributed uniformly in the form of spindles in the matrix metal.

SUMMARY OF THE INVENTION

An object of the present invention is to provide a sintered material having a high damping capacity and wearing resistance and a method of producing the same.

According to the present invention, a mixture of powdery lead or graphite and a powdery matrix metal is compression-molded, then sealed in a vessel, subjected to rolling process and sintered at a high temperature. Namely, lead or graphite is distributed uniformly in the form of spindles in the matrix metal to improve damping capacity of the sintered material by subjecting the compression-molded mixture to the rolling process.

DETAILED DESCRIPTION OF THE PREFERRED EMBODIMENT

Figure 1:
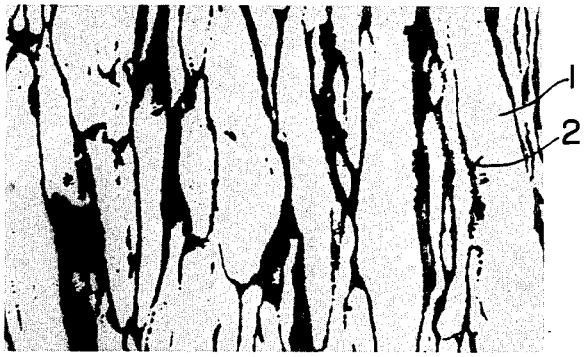
FIG. 1 shows a section of a Fe-15 wt. % Pb sintered material produced by the method of the present invention.

According to the present invention, lead and graphite are used for increasing wearing resistance as described above. With a lead or graphite content of less than 5 wt. %, self-lubricating property is insufficient and, therefore, wearing resistance cannot be improved, though mechanical strength is high. On the other hand, with a lead or graphite content of more than 30 wt. %, mechanical strength, particularly compression strength, becomes too low to be used as a bearing material.

A matrix metal is selected from the group consisting of iron, copper, aluminum, cast iron and alloys thereof. Particularly, cast iron is preferred, since graphite contained therein acts as a damping material.

According to ingot method, compatibility of lead or graphite with a matrix element such as iron, copper or aluminum is poor and, in addition, differences between them in specific gravity and solidification temperature are large and, consequently, the metals are separated into two phases in the solidification step and lead or graphite cannot be distributed uniformly in the matrix. Therefore, according to the present invention, both lead or graphite and matrix metal to be mixed together are used in the form of powders. The mixture is compression-molded, subjected to plastic treatment and sintered by heating.

The powdery metal may be either spherical particles or cuttings. The compression-molded mixture is sealed in a vessel. It is desirable that the vessel has as excellent as possible workability, since it is subjected to plastic treatment later. For example, an iron or copper vessel is preferred. The metal powders thus sealed in the vessel are then subjected to plastic treatment.

The plastic treatment may be effected by either cold or hot working. In case of hot working, it is desirable to effect the treatment in a reducing atmosphere with regard to the fact that the sealing of the vessel is sometimes incomplete. By the plastic treatment, the powders in the vessel are intimately adhered to each other.

After completion of the plastic treatment, the vessel is heated to sinter the metal powders in the vessel. Heating temperature in this step is above recrystallization point of the matrix metal. By heating the metal powders to a temperature above recrystallization point of the matrix metal, the matrix metal is recrystallized. On the other hand, powdery lead or graphite is aggregated in the form of spindles on the crystal surface of the matrix metal or in the crystals.

The steps of plastic treatment and sintering are each not limited to once but they may be effected repeatedly. The repetition of the steps improves adhesion of the metal powders and serves for shaping the powdery lead or graphite into spindle form which is suitable for increasing damping capacity.

EXAMPLE 1

Powdery iron and powdery lead each having a particle size of smaller than 100 mesh were used. Three mixtures comprising 5 wt. %, 15 wt. % and 30 wt. % of the powdery lead and the remainder of the powdery iron were prepared. From the three mixtures, sintered materials were prepared by a process described below.

The mixture was charged in a pipe made of a rolled steel for general structures (JIS SS 41) of an outer diameter of 36 mmϕ and an inner diameter of 30 mmϕ and then compression-molded under a face pressure of 4 ton/cm$^2$. After completion of the compression molding, both ends of the pipe were sealed and cold swaging plastic treatment was effected till a degree of working of 50% was attained. The metal composition thus treated was sintered by heating at 650° C. in hydrogen atmosphere for 30 minutes. Then, the cold swaging plastic treatment was effected again till a degree of working of 50% was attained and then it was heated at 750° C. in hydrogen atmosphere for 30 minutes.

Section of the sintered material of 30% lead content produced as above is shown in FIG. 1. It is seen that recrystallized iron forms matrix 1. In the matrix 1, lead 2 is aggregated in the form of long spindles. In Example 1, lead was in the form of elongated spindles to exhibit an improved damping capacity, since the steps of plastic treatment and sintering were repeated twice.

EXAMPLE 2

Powdery copper and powdery lead each having a particle size of smaller than 100 mesh were used. Three mixtures comprising 5 wt. %, 15 wt. % and 30 wt. % of the powdery lead and the remainder of the powdery copper were prepared. From those mixtures, sintered materials were prepared in the same manner as in Example 1 except that the heating in the first and the second sintering steps was effected at 400° C. for 30 minutes.

EXAMPLE 3

Cuttings of gray cast iron (JIS FC 25) and powdery lead each having a particle size of smaller than 24 mesh were used. Three mixtures comprising 5 wt. %, 15 wt. % and 30 wt. % of the powdery lead and the remainder of the powdery gray cast iron were prepared. From those mixtures, sintered materials were prepared in the same manner as in Example 1 except that in the first and the second plastic treatment steps, degree of working was 60% and the heating in the sintering steps was effected at 650° C. for 30 minutes.

EXAMPLE 4

Powdery Al-5 wt. % Sn alloy and powdery lead each having a particle size of smaller than 100 mesh were used. Five mixtures containing 10 wt. %, 15 wt. %, 20 wt. %, 25 wt. % and 30 wt, % of the powdery lead were prepared. Those mixtures were compression-molded under a face pressure of 1 ton/cm$^2$ and sealed in a vessel. Then, the sealed mixtures were subjected to swaging plastic treatment till a degree of working of 80% was attained. Thereafter, they were sintered by heating at 300° C. in hydrogen atmosphere for one hour. The plastic treatment step and the sintering step were repeated again under the same conditions.

The sintered materials obtained in the above examples were tested for the confirmation of their camping capacities and wearing resistances.

EXPERIMENT 1

Figure 2:
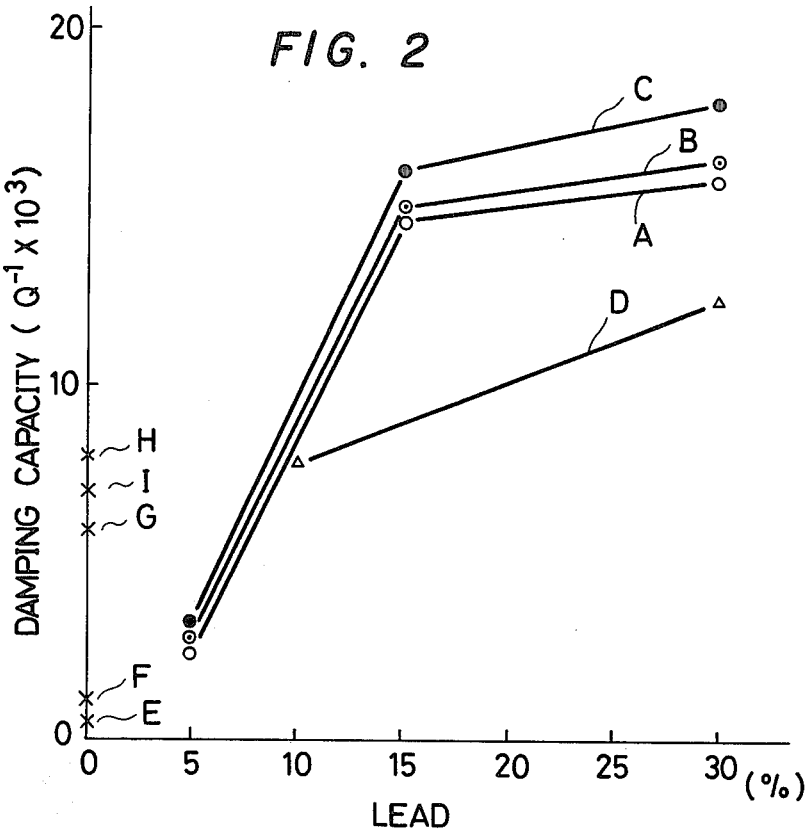
FIG. 2 is a graph showing a relationship between iron content and damping capacity of sintered materials of the present invention containing one of iron, copper, aluminum and cast iron.

Test pieces of a size of 5 mm width×2.5 mm thickness ×120 mm length were prepared from 9 sintered materials obtained in Examples 1–3 and two sintered materials selected from those obtained in Example 4. The test pieces were vibrated laterally to confirm their damping capacities. The results are shown in FIG. 2. In FIG. 2, the abscissa shows lead content of the material and the ordinate shows damping capacity $Q^{-1}$ ($Q=\delta/\pi$ wherein $\delta$ represents logarithmic decrement). Further, in FIG. 2, symbols A, B, C and D represent experimental results of test pieces; A showing the results of test pieces comprising iron and lead prepared in Example 1, B showing the results of test pieces comprising copper and lead prepared in Example 2, C showing the results of test pieces comprising gray cast iron and lead prepared in Example 3, and D showing the results of test pieces comprising Al-5 wt. % Sn alloy and lead prepared in Example 4. Points E, F, G, H and I are given for the comparison with damping capacities of the sintered materials of the present invention; E, F and G showing damping capacities of lead-free iron, copper and gray cast iron, respectively and H and I showing damping capacities of Mn-Cn alloy and flaky graphite cast iron (JIS FC 10), respectively, which are used generally as damping materials.

In FIG. 2, the higher the iron content is, the higher the damping capacity of the material is. However, with more than 30 wt. % or lead, mechanical strength of the material is deteriorated and it cannot be used as a bearing material. It is understood that the sintered materials according to the present invention have a damping capacity equivalent or superior to those of the Mn-Cn alloy and flaky graphite cast iron (JIS FC 10) used generally as damping materials.

EXPERIMENT 2

Figure 3:
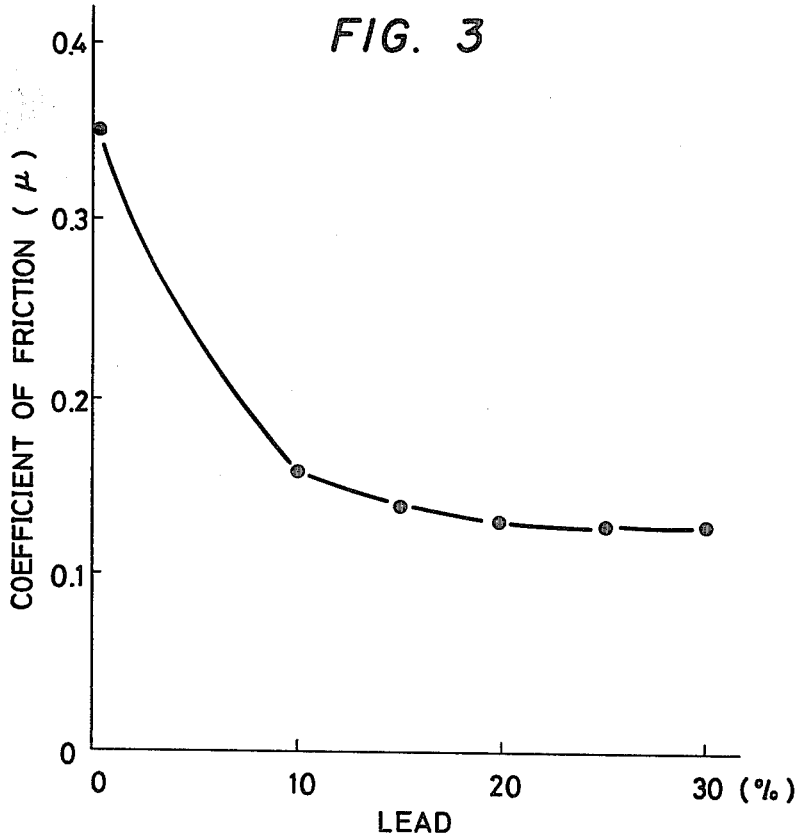
FIG. 3 is a graph showing a relationship between iron content and coefficient of friction ($\mu$) of a sintered material of the present invention containing aluminum as matrix metal.

Coefficients of friction of Al alloys of lead contents of 10 wt. %, 15 wt. %, 20 wt. %, 25 wt. % and 30 wt. % obtained in Example 4 were measured. The results are shown in FIG. 3. It is noted from FIG. 3 that the material of 10 wt. % lead content has about ½ time as high coefficient of friction as the lead-free Al alloy. This fact indicates that the Al alloy according to the present invention has an excellent wearing resistance.

EXPERIMENT 3

From the materials obtained in Examples 1 and 2, sintered material of iron containing 15 wt. % of lead (Fe-15 wt. % Pb) and sintered material of copper containing 15 wt. % of lead (Cu-15 wt. % Pb) were selected and wearing resistances of them were examined. The Fe-15 wt. % Pb was compared with ingot iron. Both materials were rubbed with a copper alloy to determine their abrasion wears. The Cu-15 wt. % Pb was compared with ingot copper. Both materials were rubbed with a structural carbon steel stock (JIS S 45 C) to determine their abrasion wears. Experimental conditions comprise a face pressure of 7 kg/cm$^2$ and a friction velocity of 0.2 m/sec. in a turbine oil. The results are shown in the following table:

TABLE

| Material | | Abrasion wear |
|---|---|---|
| Fe-15 wt. % Pb | (13.0 g) | 0.4 mg |
| Ingot Fe | (11.5 g) | 2.0 mg |
| Cu-15 wt. % Pb | (14.8 g) | 0.5 mg |
| Ingot Cu | (13.5 g) | 5.0 mg |

From the table, it is understood that the sintered materials according to the present invention exhibit a small abrasion wear and therefore, an excellent wearing resistance.

What we claim is:

1. A method of producing a sintered material comprising the steps of:

mixing a powdery metal selected from the group consisting of lead, graphite and magnesium with a powdery matrix metal selected from the group consisting of iron, copper, aluminum, cast iron and alloys thereof;

compression-molding the powdery metal mixture;

sealing the compression-molded powdery metal mixture within a vessel;

subjecting the vessel and the compression-molded powdery metal sealed therein to plastic treatment so that lead, graphite or magnesium is dispersed uniformly in the form of spindles in the matrix metal; and sintering the thus treated metal composition by heating to a temperature above a recrystallization point of the matrix metal.

2. A method of producing sintered material comprising the steps of:

mixing 5–30 wt. % of powdery lead with the remainder of a powdery matrix metal selected from the group consisting of iron, copper, aluminum, cast iron and alloys thereof;

compression-molding the powdery metal mixture;

sealing the compression-molded powdery metal mixture within a vessel;

subjecting the vessel and the compression-molded powdery metal sealed therein to plastic treatment so that lead is dispersed uniformly in the form of spindles in the matrix metal; and sintering the thus treated metal composition by heating to a temperature above a recrystallization point of the matrix metal.

3. The method of producing sintered material defined by either claim 1 or 2, characterized in that the steps of plastic treatment and sintering are repeated twice or more.

4. The method of producing sintered material defined by either claim 1 or claim 2, characterized in that the sintering operation takes place in a hydrogen atmosphere.

5. The method of producing sintered material defined by either claim 1 or claim 2, characterized in that the vessel is formed of a metal exhibiting excellent workability.

6. The method of producing sintered material defined by either claim 1 or claim 2, characterized in that the vessel in which the compression-molded powdery metal mixture is sealed is formed of iron or copper.

7. The method of producing sintered material defined by either claim 1 or claim 2, characterized in that the vessel containing the plastic treated metal composition therein is heated to a temperature above a recrystallization of the matrix metal to effect sintering of the thus-treated metal composition.

* * * * *